US006529831B1

(12) United States Patent
Smith et al.

(10) Patent No.: US 6,529,831 B1
(45) Date of Patent: Mar. 4, 2003

(54) EMERGENCY VEHICLE LOCATOR AND PROXIMITY WARNING SYSTEM

(75) Inventors: Gordon James Smith, Rochester, MN (US); George Willard Van Leeuwen, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/598,817

(22) Filed: Jun. 21, 2000

(51) Int. Cl.[7] ..... G08G 1/123; G08G 7/00; G08G 1/07

(52) U.S. Cl. ..... 701/301; 701/300; 340/903; 342/455

(58) Field of Search ..... 701/300, 301, 701/302; 340/903, 902, 905, 988, 901, 435, 436; 342/455, 357.08, 357.09

(56) References Cited

U.S. PATENT DOCUMENTS 3,964,702 A * 6/1976 Lardennois et al. ..... 246/4
4,833,469 A * 5/1989 David ..... 340/901
4,914,434 A * 4/1990 Morgan et al. ..... 340/906
4,965,583 A * 10/1990 Broxmeyer ..... 342/42
5,307,060 A * 4/1994 Prevulsky et al. ..... 340/902
5,311,197 A * 5/1994 Sorden et al. ..... 342/457
5,574,469 A * 11/1996 Hsu ..... 342/455
5,594,432 A * 1/1997 Oliva et al. ..... 340/905
5,835,008 A * 11/1998 Colemere, Jr. ..... 340/439
6,084,508 A * 7/2000 Mai et al. ..... 340/463
6,198,993 B1 * 3/2001 Higashi et al. ..... 701/23
6,218,961 B1 * 4/2001 Gross et al. ..... 340/903
6,223,125 B1 * 4/2001 Hall ..... 701/301
6,275,773 B1 * 8/2001 Lemelson et al. ..... 701/301
6,326,903 B1 * 12/2001 Gross et al. ..... 340/988

* cited by examiner

*Primary Examiner*—Tan Q. Nguyen
*Assistant Examiner*—Dalena Tran
(74) *Attorney, Agent, or Firm*—Lawrence D. Maxwell; Roy W. Truelson

(57) ABSTRACT

A method and system for alerting a driver of a commercial vehicle or private vehicle, such as a truck or automobile, of an approaching emergency vehicle, such as a police or fire vehicle, and vice versa. The system includes a navigation information system in each vehicle, a transmitter in the second vehicle, a receiver in the first vehicle, a processing system, and a warning system in the first vehicle. Each navigation information system provides data that describe the geographic position and speed of the vehicle. The receiver in the first vehicle receives the navigation information transmitted by the second vehicle. The processor and associated electronics in the first vehicle determines the position and direction of travel of the second vehicle relative to the first vehicle. The warning system in the first vehicle provides a suitable indication to alert the driver if it is determined that the two vehicles are likely to collide.

22 Claims, 5 Drawing Sheets

EMERGENCY VEHICLE LOCATOR AND PROXIMITY WARNING SYSTEM

BACKGROUND OF THE INVENTION

1. Field of the Invention

The present invention relates to systems for warning of impending vehicle collisions.

2. Description of the Related Art

Emergency vehicles such as fire trucks, police cars, ambulances and rescue vehicles, speeding toward a destination, pose a potential collision hazard to other motorists, particularly in metropolitan areas. Although emergency vehicles typically have sirens and lights to warn of their approach, these warning devices are of limited effectiveness. The direction from which a siren is approaching may be difficult for motorists to judge due to sound reflections from buildings. Flashing lights are only visible to motorists within a clear line of sight from the emergency vehicle, e.g., to motorists on the same straight section of street as the emergency vehicle. For example, a motorist on a street around the corner from the emergency vehicle may not be able to determine the location of the emergency vehicle or judge whether he is in danger of colliding with the emergency vehicle until it is too late; by the time the driver sees the emergency vehicle he may not have time to react. Furthermore, even if a motorist is able to judge the direction from which an emergency vehicle is approaching, the motorist may have difficulty judging the speed at which it is approaching. The more concentrated the buildings and other obstructions, the greater these difficulties. Even in rural areas, approaching emergency vehicles pose a danger to motorists because the sirens and lights of the emergency vehicles divert motorists' attention from driving.

It would be desirable to provide an effective system for warning drivers of approaching emergency vehicles. The present invention addresses these problems and deficiencies and others in the manner described below.

SUMMARY OF THE INVENTION

The present invention relates to a method and system for alerting a driver of a first vehicle of an approaching second vehicle that includes a navigation information system in each vehicle, a transmitter in the second vehicle, a receiver in the first vehicle, a processing system, and a warning system in the first vehicle. One of the vehicles may be a private or commercial vehicle such as an automobile, while the other may be an emergency vehicle such as an ambulance, firefighting vehicle, police vehicle or a rescue vehicle. Each navigation information system provides data that describe the geographic position and speed of the vehicle. The navigation information systems may, for example, use the global positioning satellite (GPS) system to obtain such data, or may obtain some or all such data from sensors and systems integral to the vehicle, such as a speedometer. The transmitter transmits at least a portion of the navigation information relating to the second vehicle. The receiver receives movement information that may consist of the transmitted navigation information or include at least a portion of it. Alternatively, the movement information that the receiver receives may consist of information transmitted by a base station at a geographically fixed location or at least include a portion of it. The processor, which may be located in the first vehicle or, alternatively, at any other suitable location, such as a base station or another vehicle, determines the position and direction of travel of the second vehicle relative to the first vehicle in response to the movement information and the navigation information relating to the first vehicle. The movement information may consist of any suitable information associated with relative movement of first and second vehicles, including a straightforward warning signal, but preferably includes the navigation information relating to the second vehicle. The warning system in the first vehicle provides a suitable indication to alert the driver if the processing system determines that the first and second vehicles are within a predetermined proximity of one another, though in some embodiments of the invention the warning system may take other parameters into account, such as the course on which the vehicles are headed and whether they are therefore likely to collide. In some embodiments of the invention, the warning system may provide additional information, such as indications of the direction and speed of the vehicles relative to one another. The indicator devices that provide such indications may include any suitable audible or visual displays, including straightforward indicator lights, buzzers and the like, as well as more sophisticated map-like graphical displays. It is-also contemplated that graphical information can be provided to one or both drivers that indicates a safer alternative route, i.e., a route that is not likely to intersect with the route of the other vehicle.

The present invention provides rapid identification of the relative location and speed between two vehicles, such as a private (or commercial) vehicle and an emergency vehicle. The invention can alert the driver of the private vehicle of the presence of an emergency vehicle, even if the vehicles are still far apart but are headed on courses that are likely to intersect one another. A novel visual display can be included to show the location of both vehicles. The invention can thus enhance safety for the drivers of both private and commercial vehicles.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF A PREFERRED EMBODIMENT

Figure 1:
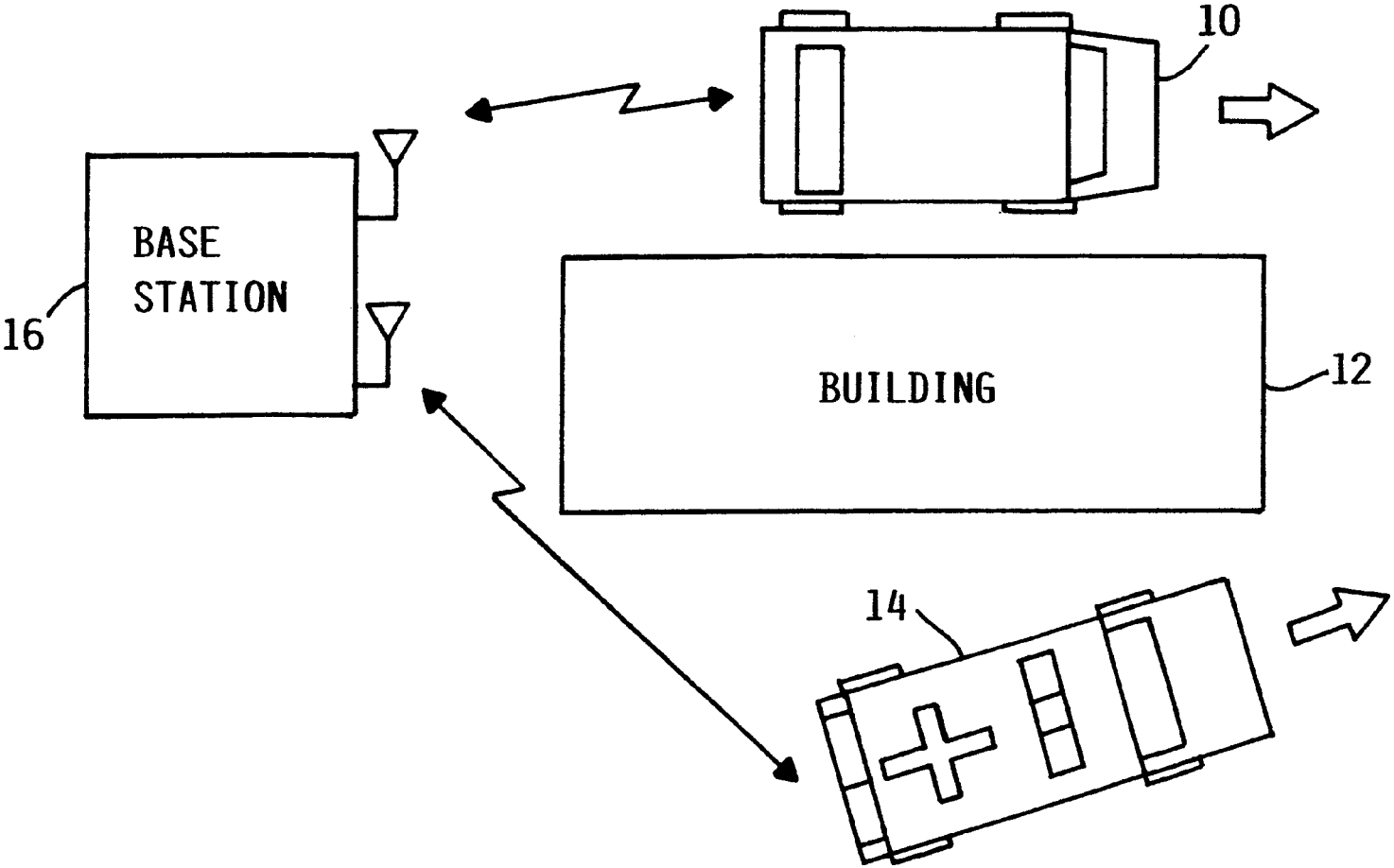
FIG. 1 illustrates a system in which information is transmitted from an emergency vehicle to a base station and transmitted from the base station to a commercial or private vehicle.

As illustrated in FIG. 1, a first vehicle 10, which is a private or commercial vehicle such as an automobile, is headed in a certain direction on one side of a building 12, while a second vehicle 14, which is an emergency vehicle such as an ambulance, firefighting vehicle, police vehicle or a rescue vehicle, is headed in another direction on the other side of the building. (Note that-the terms "first"vehicle" and "second vehicle" are used merely as convenient labels and are not intended to indicate any order or other information.) For purposes of illustration, it is assumed that if vehicles 10 and 14 continue along the paths or courses on which they are shown at their present speeds, they are likely to soon collide, perhaps within the next minute or two. It is a scenario such as this that the present invention is intended to address. The driver of vehicle 10 cannot see vehicle 14 because building 12 blocks his view. The driver of vehicle 14 cannot see vehicle 12 for the same reason. Once vehicles 10 and 14 have passed building 12, they may be within seconds of colliding with each other, too late for either driver to take action to avoid the collision.

Vehicle 10 receives movement information signals that describe the location and speed of vehicle 14 or at least signals from which the location, direction and speed of vehicle 14 can be computed or otherwise derived. Because, as described in further detail below, vehicle 10 is able to determine its own location, direction and speed, it can be computed whether vehicles 10 and 14 are on a collision course or at whether they are in such close proximity to one another that the likelihood of a collision is significant. In the most straight-forward embodiment of the invention wherein vehicle 10 determines only whether it is within a predetermined distance of vehicle 14, vehicle 10 need only process movement information that describes the location of vehicles 10 and 14. Nevertheless, in a preferred embodiment vehicle 10 processes movement information that describes not only the location of vehicles 10 and 14 but also the direction and speed of vehicles 10 and 14. As described below in further detail, if the processing indicates that the driver of vehicle 10 should be warned of the proximity of vehicle 14, a suitable audible or visual warning is issued.

Note that, for purposes of clarity, in the illustrated embodiment of the invention only the driver of vehicle 10 is warned. Nevertheless, in other embodiments of the invention, vehicle 14 may process the same movement information and issue a warning to the driver of vehicle 14 as well. In such embodiments, vehicle 14 would receive movement information signals relating to the movement of vehicle 10. In other words, it is contemplated that either or both of vehicles 10 and 14 can receive such signals, perform such processing and issue such warnings, as indicated by the double-headed arrows in FIG. 1 indicating bidirectional communication of signals.

In a preferred embodiment, a base station 16 at a fixed geographic location receives the movement information signals transmitted by vehicle 14 and relays them to vehicle 10. This method minimizes problems associated with the reflection or blockage of signals by obstructions such as building 12. Nevertheless, in other embodiments, such signals can be transmitted directly between vehicles 10 and 14. Furthermore, some or all of the processing can be performed at base station 16 instead of vehicle 10. Suitable radio transmission systems for communicating digital information between moving vehicles and base stations are well-known in the art, including those associated with cellular and PCS telephone communication. Therefore, the details of the data communication system are not described in this patent specification.

Figure 2:
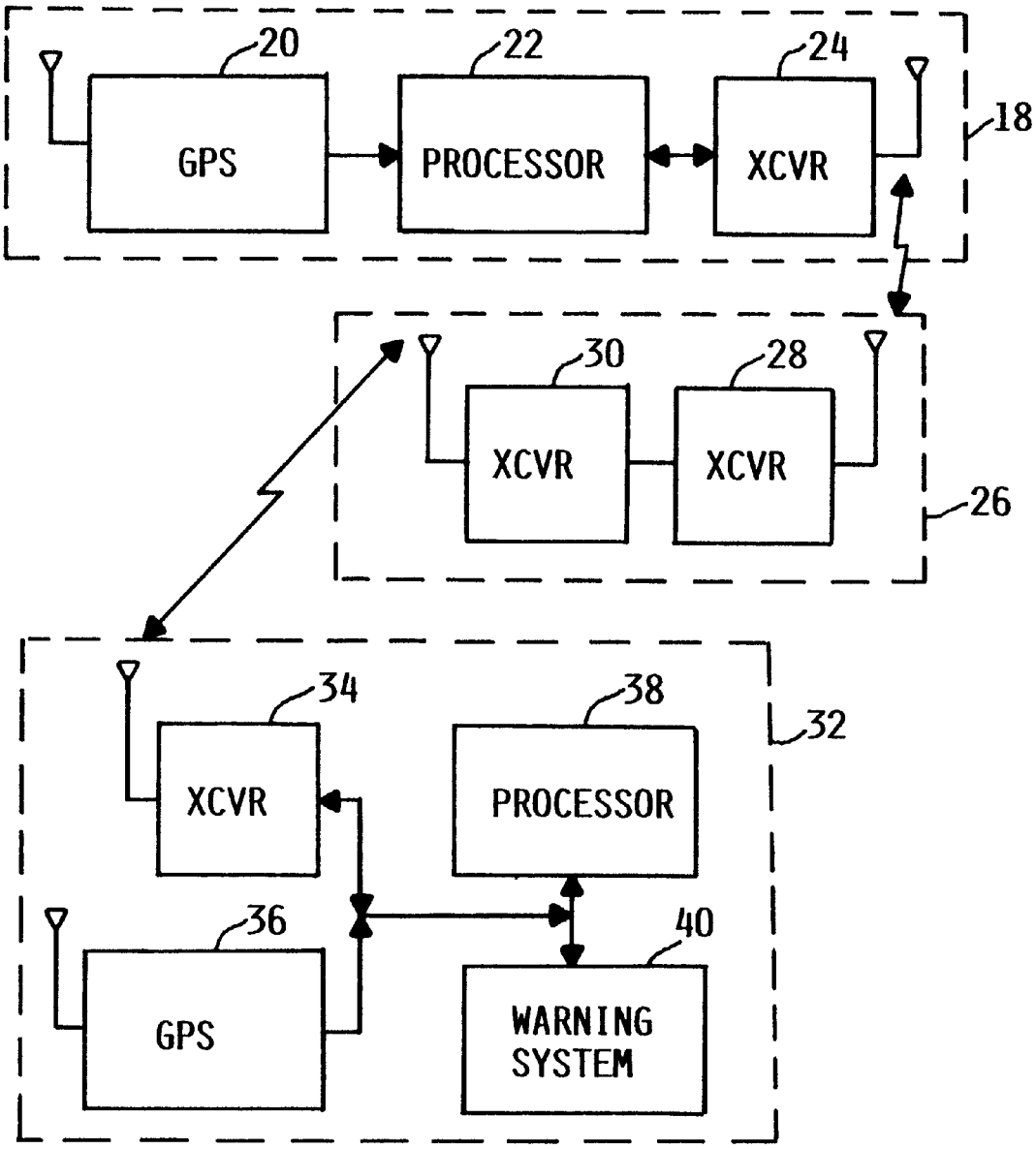
FIG. 2 is a schematic block diagram of the system electronics.

As illustrated in FIG. 2, a second vehicle electronic system 18 is mounted or otherwise suitably carried aboard vehicle 14. (Note that in embodiments of the invention in which the drivers of both vehicles 10 and 14 are warned, a similar system is carried aboard vehicle 10 as well.) It includes a global positioning satellite (GPS) receiver 20 that determines the location of vehicle 10 using the well-known GPS system, a processor 22 that processes the data provided by GPS receiver 20 to make it suitable for transmission, and a radio transceiver 24 that transmits the processed location information in a suitable digitally encoded format. In this embodiment of the invention, the movement information consists of the information derived from the GPS signals that describes the location of vehicle 14. A base station electronic system 26 is located at base station 16. It includes a radio transceiver 28 that receives the movement information signals transmitted by transceiver 24 and a radio transceiver 30 that re-transmits these movement information signals. (Alternatively, a single transceiver could be used to both transmit and receive.) As noted above, in other embodiments of the invention, additional processing may occur at the base station, such as receiving movement information signals from vehicle 10 as well and making determinations such as collision likelihood estimates based upon movement information signals received from both vehicles 10 and 14. Note that although GPS is used in the illustrated embodiment of the invention as the source of the location information, in other embodiments inertial navigation systems, radio triangulation systems or other suitable sources of location information may be used.

A first vehicle electronic system 32 is mounted in or otherwise suitably carried in vehicle 10. (Note that in embodiments of the invention in which the drivers of both vehicles 10 and 14 are warned, a similar system is carried aboard vehicle 14 as well.) It includes a radio transceiver 34, a GPS receiver 36, a processor 38 and a warning system 40. Transceiver 34 receives the movement information transmitted from base station electronic system 26. GPS receiver 36 provides information describing the location of vehicle 10. In response to the movement information and the information describing the location of vehicle 10, processor 38 determines whether a warning should be issued to the driver of vehicle 10. Although in other embodiments of the invention the criteria on which this decision is based can be as straightforward as whether vehicles 10 and 14 are within a predetermined distance of each other, in the preferred embodiment a warning is preferably issued if vehicles 10 and 14 are likely to collide. That is, a warning is issued if vehicle 10 is predicted to arrive, based upon its location, direction of travel and speed, at the same geographic location as that at which vehicle 14 is predicted to arrive, based upon its location, direction and speed of travel.

Figure 3:
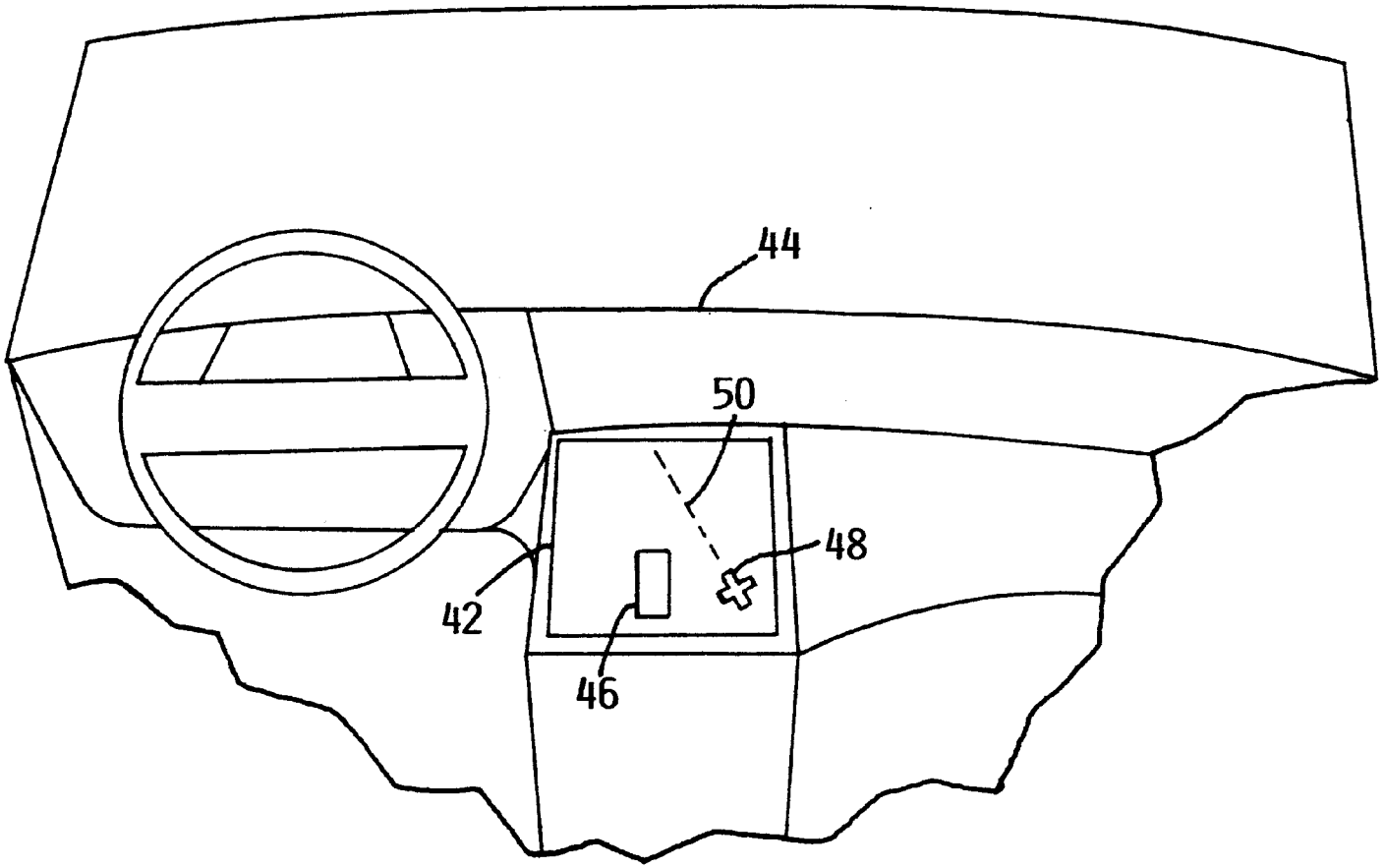
FIG. 3 illustrates the display in the commercial or private vehicle.

As illustrated in FIG. 3, a preferred warning indication system includes a map-like graphical display 42 mounted on or near the dashboard 44 of vehicle 10. Display 42 shows an icon 46 representing vehicle 10, an icon 48 representing vehicle 14, and a dashed line 50 representing the predicted path of travel of vehicle. As described below, the computations are updated essentially in real-time as vehicles 10 and 14 continue to move, and display 42 is updated to indicate the new positions of vehicles 10 and 14 relative to one another. In addition to or in place of this preferred warning indication system, the warning system may further include any suitable indicator lamps, buzzers, sirens, digitized voice warning or the like for indicating the conditions described below with respect to FIGS. 4 and 5. It is also contemplated that other information, such as the type of vehicle (e.g., fire, police, etc.), its speed, or other pertinent information may be displayed. Also note that, as mentioned above, in other embodiments of the invention a similar warning indication system may be included in vehicle 14 as well. It is further contemplated that, in other embodiments of the invention, an alternative route may be computed and displayed for the drivers of one or both vehicles.

As illustrated in FIG. 3, processor 38 performs computations based upon the GPS location data it receives that describes the location of vehicles 10 and 14 and also based upon the destination of vehicle 14. Preferably, the destination of vehicle 14 is predetermined, i.e., made available to processor 38 and not changed during the computations described herein. For example, it may be known that vehicle 14 is associated with a certain hospital, and the coordinates (latitude and longitude) of the hospital can be transmitted to first vehicle electronic system 32, e.g., by base station 16, or pre-programmed therein. Nevertheless, in other embodiments of the invention, the destination of vehicle 14 can be estimated or provided in some other manner.

Figure 4:
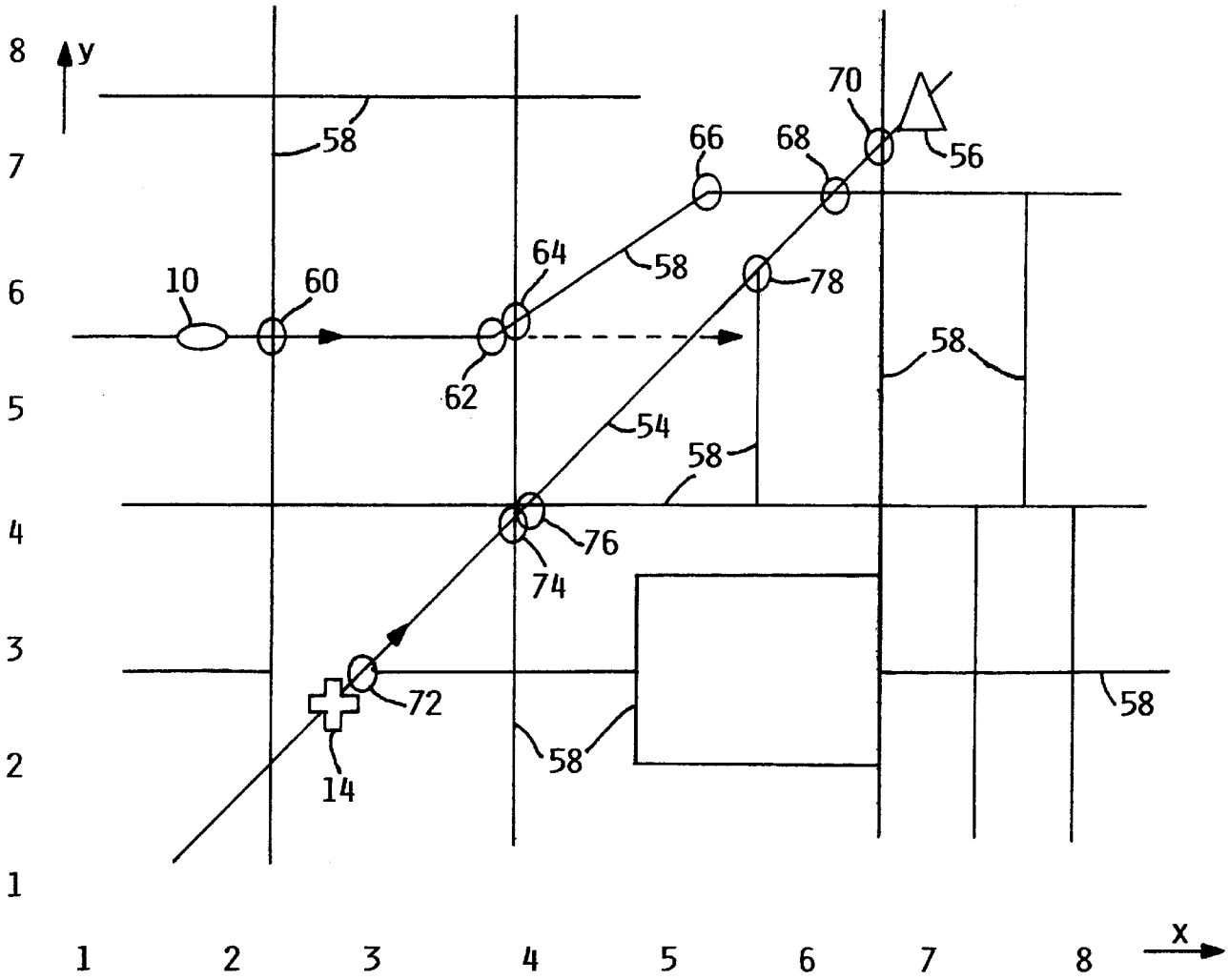
FIG. 4 is a map-like diagram illustrating the geometry underlying the computation.
Figure 5:
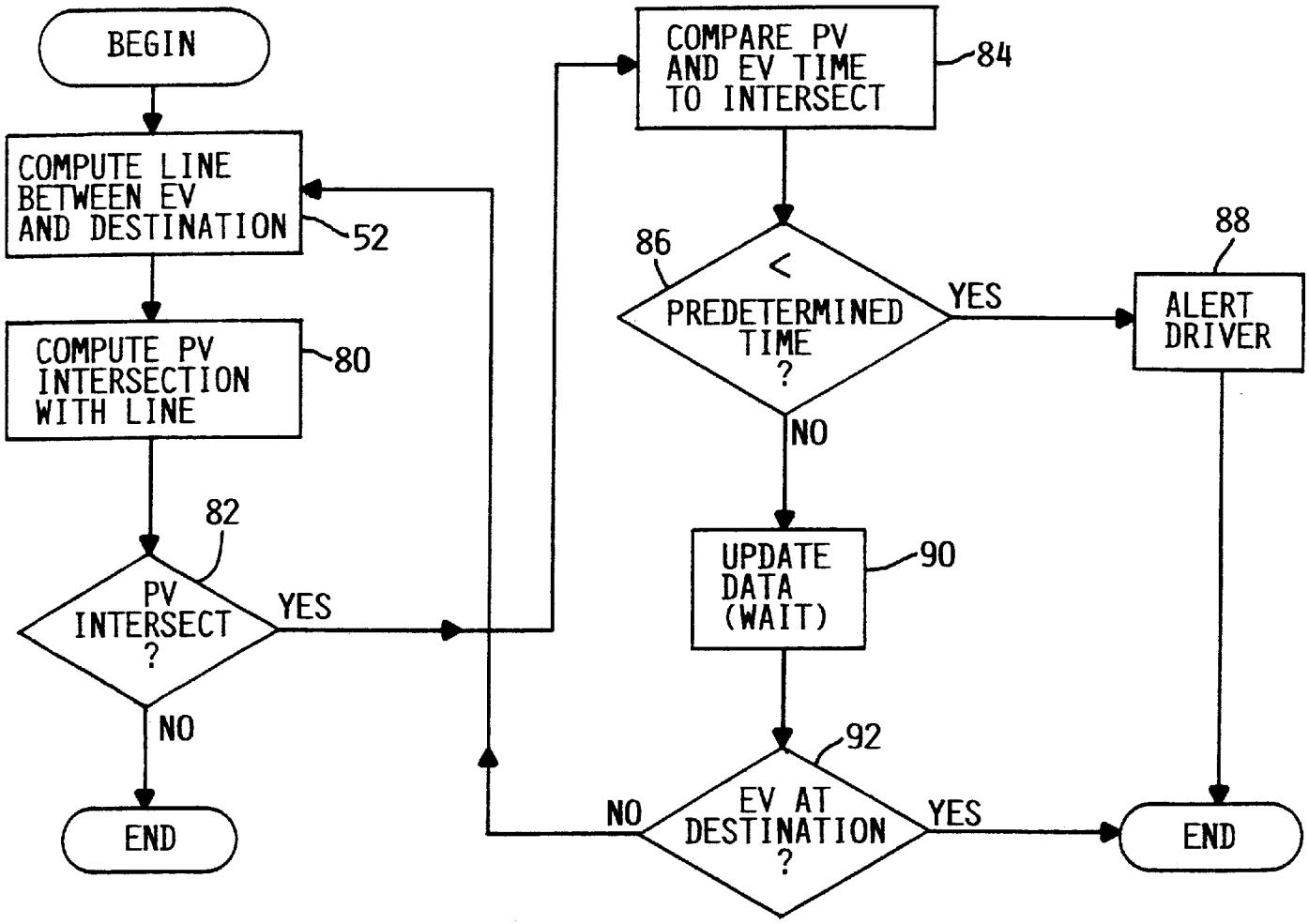
FIG. 5 is a flow diagram illustrating the computation of an estimate of whether the emergency vehicle and the other vehicle are likely to collide.

FIG. 4 is a map-like diagram illustrating the geometry underlying the trajectory computations. FIG. 5 illustrates how the diagram is used in the overall method of the invention. At step 52, a line 54 between the position of vehicle 14, which is the emergency vehicle ("EV"), and its destination 56 is computed. The speed and direction of vehicle 14 are determined by monitoring the change in location of vehicle 14 and the amount of time over which that change occurred. Processor 38 maintains an internal timer or clock for purposes of factoring elapsed time into the computations. FIG. 4 shows vehicles 10 and 14 in relation to coordinates on an X axis and a Y axis. (For purposes of illustration, the coordinates are numbered 1–8 on each axis.) FIG. 4 further shows streets 58 on which vehicles 10 and 14 can travel. The locations of streets 58 can be provided to processor 38 in any suitable manner. For example, as is common in automobile navigation systems, local street information can be pre-programmed into processor 38 and its associated local memory by means of a CD-ROM or other suitable memory device (not shown). Alternatively, such information can be received from base station electronics 26. The locations of streets 58 are relevant because, although the locations and trajectories of vehicles 10 and 14 can be updated as frequently as the electronics will allow new movement information to be obtained, the locations and trajectories are preferably only updated or re-computed at intersections (where two roads meet). Alternatively, the locations and trajectories can be updated when the direction of a street changes or when the destination of vehicle 14 changes. In the example shown in FIG. 5, the intersections at which the computations are performed are referred to as intersection points (IPs) and labeled with ellipses 60, 62, 64, 66, 68, 70, 72, 74, 76 and 78.

At step 80, a line that follows the path or trajectory of vehicle 10, which is the private or commercial vehicle ("PV"), between vehicle 10 and line 54 is computed. The trajectory of vehicle 10 can be determined because its speed and direction are determined in the same manner described above with respect to vehicle 14. In the example shown in FIG. 4, the trajectories of vehicles 10 and 14 are indicated by arrows. The dashed line arrow is intended to indicate that no street exists along the trajectory of vehicle 10 between vehicle 10 and line 54, i.e., that the streets 58 on which vehicles 10 and 14 are traveling do not intersect. Therefore, at step 82 it is determined in this example that when vehicle 10 is at IP 60 it is not likely to collide with vehicle 14. Processor 38 thus ends the current iteration of the computations and does not begin again at step 52 until vehicle 10 reaches the next IP 62. When steps 80 and 82 are performed after vehicle 10 passes IP 62 and again after vehicle 10 passes IP 64, it is again determined that vehicle 10 is not likely to collide with vehicle 14 because there is no street 58 along the trajectory of vehicle 10 that intersects line 54. (Note that the trajectories may be curved.) Nevertheless, when steps 80 and 82 are performed after vehicle 10 reaches IP 66, its trajectory will be determined to be aligned along a street 58 that intersects line 54. (In this example, note that line 54 is aligned with a street as well.) At that point, vehicles 10 and 14 are likely to collide at IP 68.

If it is determined at step 82 that vehicles 10 and 14 are likely to collide (e.g., at IP 68) then at step 84 the amount of time it will take each of vehicles 10 and 14 to reach the point of collision (IP 68 in this example) is computed. This amount of time can be computed from distance information obtained from the street map, dividing the distance between each of vehicles 10 and 14 and the point of collision by its then current speed. At step 86 it is computed whether the time it is estimated to take vehicle 10 to reach this point and the time it is estimated to take vehicle 14 to reach this point are both less than a predetermined amount of time, such as ten seconds. If both vehicles 10 and 14 are estimated to reach the collision point within this predetermined amount of time, i.e., a time window, then at step 88 processor 38 causes warning system 40 (FIG. 2) to alert the driver of vehicle 10 by means of an audible or visual device such as a buzzer, warning lamp or voice synthesizer. In addition to the map display illustrated in FIG. 3 and warning the driver by such means, various types of warnings are contemplated. For example, the driver can be advised to reduce speed or advised of an alternate route to take. The driver can also be advised if his address is the destination of vehicle 14.

If one or both of vehicles 10 and 14 are not estimated to reach the collision point within the predetermined amount of time, processor 38 temporarily suspends processing at step 90, waiting until vehicle 10 reaches the next IP to resume processing. At step 92 it is determined whether vehicle 14 has reached its destination 56. If it has, processor 38 ends its computations and does not resume until vehicle 14 has left destination 56. If it is determined at step 92 that vehicle 14 has not reached its destination 56, processing returns to step 52.

If vehicle 10 will reach the destination of emergency vehicle 14 after vehicle 14 arrives, the driver of vehicle 10 may be advised to avoid the destination area, e.g., the driver may be provided with an alternative route.

It will be evident that there are numerous embodiments of the present invention, which, while not specifically described above, are clearly within the scope and spirit of the invention. Consequently, the above description is considered to be exemplary only, and the full scope of the invention is to be determined solely by the appended claims.

What is claimed is:

1. A system for alerting a driver of a first vehicle of an approaching emergency vehicle, said first and emergency vehicles being land vehicles for operation on public streets, said system comprising:

a navigation information system in said first vehicle providing first vehicle navigation information including geographic position, direction and speed of said first vehicle;

a navigation information system in said emergency vehicle providing emergency vehicle navigation information including geographic position, direction and speed of said emergency vehicle;

a transmitter in said emergency vehicle transmitting at least a portion of said emergency vehicle navigation information;

a receiver in said first vehicle receiving movement information associated with movement of said emergency vehicle, said movement information including at least a portion of said emergency vehicle navigation information;

a processing system in said first vehicle determining a position and direction of said emergency vehicle relative to said first vehicle in response to said first and emergency vehicle navigation information; and a warning system providing a human-perceptible indication in said first vehicle if said processing system determines said first and emergency vehicles are likely to converge within a predetermined proximity of one another;

wherein said processing system predicts whether said first and emergency vehicles will converge in response to information including a destination point of said emergency vehicle.

2. The system claimed in claim 1, wherein said emergency vehicle is selected from the group consisting of: firefighting vehicle; police vehicle; rescue vehicle; and ambulance.

3. The system claimed in claim 1, further comprising a base station at a fixed geographic location receiving said emergency vehicle navigation information transmitted by said emergency vehicle and re-transmitting said emergency vehicle navigation information to said first vehicle.

4. The system claimed in claim 1, wherein said processing system determines a location of a road intersection and updates its determination of said position and direction of said emergency vehicle relative to said first vehicle when said first vehicle is at a road intersection.

5. The system claimed in claim 1, wherein said warning system provides a visual display indicating said position of said emergency vehicle relative to said position of said first vehicle.

6. The system claimed in claim 1, wherein each of said first and emergency navigation information systems includes a global positioning satellite (GPS) receiver.

7. The system claimed in claim 6, wherein:

said processing system estimates a first amount of time for said first vehicle to reach a convergence point and a second amount of time for said emergency vehicle to reach said convergence point and determines whether both of said first and second amounts of time are less than a predetermined amount of time; and said warning system provides said indication if said processing system determines said vehicles will both reach said convergence point within said predetermined amount of time.

8. The system claimed in claim 1, wherein:

said processing system predicts whether said first and emergency vehicles will converge; and said warning system provides said indication if said processing system determines said vehicles will converge.

9. The system claimed in claim 1, wherein:

said system further comprises a base station at a fixed geographic location receiving signals transmitted by said emergency vehicle and transmitting signals to said first vehicle; and said base station transmits to said first vehicle information identifying said destination point of said emergency vehicle; and said processing system determines said convergence point in response to information including said destination point.

10. A method for alerting a driver of a first vehicle of an approaching emergency vehicle, said first and emergency vehicles being land vehicles for operation on public streets, said method comprising the steps of:

providing first vehicle navigation information in said first vehicle including geographic position, direction and speed of said first vehicle;

providing emergency vehicle navigation information in said emergency vehicle including geographic position, direction and speed of said emergency vehicle;

transmitting at least a portion of said emergency vehicle navigation information from said emergency vehicle;

receiving movement information associated with movement of said emergency vehicle in said first vehicle, said movement information including at least a portion of said emergency vehicle navigation information;

determining whether said first and emergency vehicles are likely to converge within a predetermined proximity of one another in response to said first and emergency vehicle navigation information, said determining step being performed by a processing system in said first vehicle, wherein said step of determining whether said first and emergency vehicles will converge comprises the step of predicting whether said first and emergency vehicles will converge in response to information including a destination point of said emergency vehicle; and providing a human-perceptible indication in said first vehicle if said determining step determines said first and emergency vehicles are likely to converge within a predetermined proximity of one another.

11. The method claimed in claim 10, wherein said emergency vehicle is selected from the group consisting of: firefighting vehicle; police vehicle; rescue vehicle; and ambulance.

12. The method claimed in claim 10, further comprising the step of receiving said emergency vehicle navigation information transmitted by said emergency vehicle and re-transmitting said emergency vehicle navigation information to said first vehicle.

13. The method claimed in claim 10, wherein said step of determining whether said first and emergency vehicles are likely to converge within a predetermined proximity of one another comprises the step of determining a location of a road intersection.

14. The method claimed in claim 10, wherein said warning step comprises the step of providing a visual display indicating said position of said first vehicle relative to said position of said emergency vehicle.

15. The method claimed in claim 10, wherein said step of providing first vehicle navigation information and said step of providing emergency vehicle navigation information comprises using global positioning satellite (GPS) receivers.

16. The method claimed in claim 10, wherein said step of determining a position and direction of said emergency vehicle relative to said first vehicle comprises the steps of:

predicting whether said first and emergency vehicles will converge; and providing said indication if said processing system determines said vehicles will converge.

17. The method claimed in claim 16, wherein said step of predicting whether said first and emergency vehicles will converge comprises the step of estimating a first amount of time for said first vehicle to reach a convergence point and a second amount of time for said emergency vehicle to reach said convergence point and determining whether both of said first and second amounts of time are less than a predetermined amount of time.

18. The system claimed in claim 10, further comprising the steps of:

receiving signals transmitted by said emergency vehicle at a base station at a fixed geographic location;

transmitting signals from said base station to said first vehicle, including information identifying said destination point of said emergency vehicle.

19. An emergency vehicle warning system installed in a motor vehicle for operation on public streets, said system comprising:

a navigation information system in said motor vehicle providing first vehicle navigation information including geographic position and at least some data indicating future geographic position of said motor vehicle;

a receiver in said motor vehicle receiving emergency vehicle navigation information associated with movement of an emergency vehicle, said emergency vehicle navigation information including geographic position and at least some data indicating future geographic position of said emergency vehicle;

a processing system in said motor vehicle determining whether said motor vehicle and said emergency vehicle are likely to converge within a predetermined proximity of one another in response to said first and emergency vehicle navigation information; and a warning system providing a human-perceptible indication in said motor vehicle if said processing system determines said motor vehicle and said emergency vehicle are likely to converge within a predetermined proximity of one another.

20. The system claimed in claim 19, wherein said navigation information system includes a global positioning satellite (GPS) receiver.

21. The system claimed in claim 19, wherein said processing system further determines whether said motor vehicle and said emergency vehicle are likely to converge based on street data regarding the location of streets within the vicinity of said motor vehicle.

22. The system claimed in claim 19, wherein said processing system predicts whether said motor vehicle and said emergency vehicle will converge in response to information including a destination point of said emergency vehicle.

* * * * *